US005597145A

United States Patent [19]

Meyers et al.

[11] Patent Number: 5,597,145

[45] Date of Patent: Jan. 28, 1997

[54] INDIVIDUAL SANDBAGGING ACCESSORY APPARATUS

[75] Inventors: David L. Meyers; Howard J. Hudson, both of Navarre, Fla.

[73] Assignee: Metric Systems Corporation, Fort Walton Beach, Fla.

[21] Appl. No.: 423,889

[22] Filed: Apr. 18, 1995

[51] Int. Cl.[6] ..... A63B 55/04

[52] U.S. Cl. ..... 248/97; 248/99; 248/165; 248/188

[58] Field of Search ..... 248/97, 95, 99, 248/101, 150, 151, 165, 188

[56] References Cited

U.S. PATENT DOCUMENTS

| | | | |
|---|---|---|---|
| 478,913 | 7/1892 | Bratney | 248/99 |
| 575,902 | 1/1897 | Nicholas | 248/97 |
| 754,580 | 3/1904 | Madden et al. | 248/97 |
| 1,414,575 | 5/1922 | McCart | 248/101 |
| 3,796,402 | 3/1974 | Trotta | 248/97 |
| 3,958,785 | 5/1976 | Aboud | 248/97 |
| 4,376,520 | 3/1983 | Wetherington | 248/97 |
| 4,488,697 | 12/1984 | Garvey | 248/101 |
| 4,783,031 | 11/1988 | Ebentheuer | 248/97 |
| 4,901,959 | 2/1990 | Stage | 248/97 |
| 4,940,201 | 7/1990 | Kurth | 248/101 |
| 5,058,839 | 10/1991 | Stevens | 248/97 |
| 5,107,564 | 4/1992 | Grumbles | 248/97 X |
| 5,193,770 | 3/1993 | Kildare | 248/97 |

*Primary Examiner*—Philip C. Kannan

*Attorney, Agent, or Firm*—Pravel, Hewitt, Kimball & Krieger

[57] ABSTRACT

An individual sandbagging accessory apparatus which includes a principal sandbag support portion, a plurality of removable leg members attachable to the principal sandbag support portion, for positioning the support portion above the ground; clip members for securing the upper end of a sandbag through the support system, so that once secured, there is defined an upper bag opening for delivering sand into; and a plurality of ports in the walls of the principal support portion for allowing the legs to be slidably engaged through the support portion, for defining a compact apparatus which could be secured to a backpack and easing transported.

16 Claims, 5 Drawing Sheets

INDIVIDUAL SANDBAGGING ACCESSORY APPARATUS

BACKGROUND OF THE INVENTION

1. Field of the Invention

The present invention relates to sandbagging operations. More particularly, the present invention relates to an individual sandbagging accessory which allows a sandbag to be filled by a single individual and can be stowed in a compact configuration during transport.

2. General Background

During certain emergency situations, such as flooding, or during combat, sandbags are a vital component in protection against the rising water during a flood, or from incoming shells during a combat situation. In both cases, including others, fabric bags must be filled with sand, and sealed off, to arrive at the final sandbag for use. The procedure for filling a sandbag has virtually gone unchanged over many years. For example, in a typical operation for filling sandbags, usually undertaken on an emergency basis, one person is required to hold the sandbag upright, and open, and the second person is required to shovel sand through the upper opening in the bag, until the bag is filled. This procedure is both inefficient and unsafe. First, the filling operation requires two people, instead of being carried out by a single individual. Second, there is a hazard to the person holding the bag in having to avoid the blade of the shovel making contact with the persons hand during the filling operation, which could result in serious injury. Additionally, in most emergency situations, the need for manpower is critical, and requiring two people to fill a sandbag often times is a waste of manpower. Furthermore, if a person is alone, under the current state of the art, filling a sandbag would be a very difficult operation. Therefore, it would be beneficial in the art to provide an assembly which allow sandbags to be filled by a single person, would be safe to utilize, and which assembly could be easily transported.

SUMMARY OF THE PRESENT INVENTION

The apparatus of the present invention solves the problems in the art in a simple and straightforward manner. What is provided is an individual sandbagging accessory apparatus which includes a principal sandbag support frame, a plurality of removable leg members removably attachable to the principal sandbag support frame, for positioning the support frame above the ground; clip members for securing the upper end of a sandbag through the support frame, so that once secured, there is defined an upper bag opening for shoveling sand into; and a plurality of ports in the walls of the principal support frame for allowing the legs to be slidably engaged through the ports in the support frame, for defining a compact apparatus which could be secured to a backpack and easily transported.

Therefore, it is a principal object of the present invention to provide an individual sandbagging accessory which is lightweight and stowable while not in use;

It is a further principal object of the present invention to provide an individual sandbagging accessory which converts from a first stowable configuration to a second upright configuration so that a sandbag may be secured thereto and filled by a single individual;

It is a further object of the present invention to provide an individual sandbagging accessory which allows a sandbag to be filled without a second person holding the bag open, and thus eliminating the possibility of injury to the person;

It is a further object of the present invention to provide an individual sandbagging accessory which allows for individuals in emergency situations, such as flood victims or soldiers, to easily transport the apparatus, yet easily assemble it when sandbags must be filled;

It is still a further object of the present invention to provide an individual sandbagging accessory having quick release features for quick and easy assembly and disassembly.

It is still a further object of the present invention to provide an accessory support apparatus having features for easy assembly and disassembly into a compact unit for carrying onto a knapsack or the like.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figure 1:
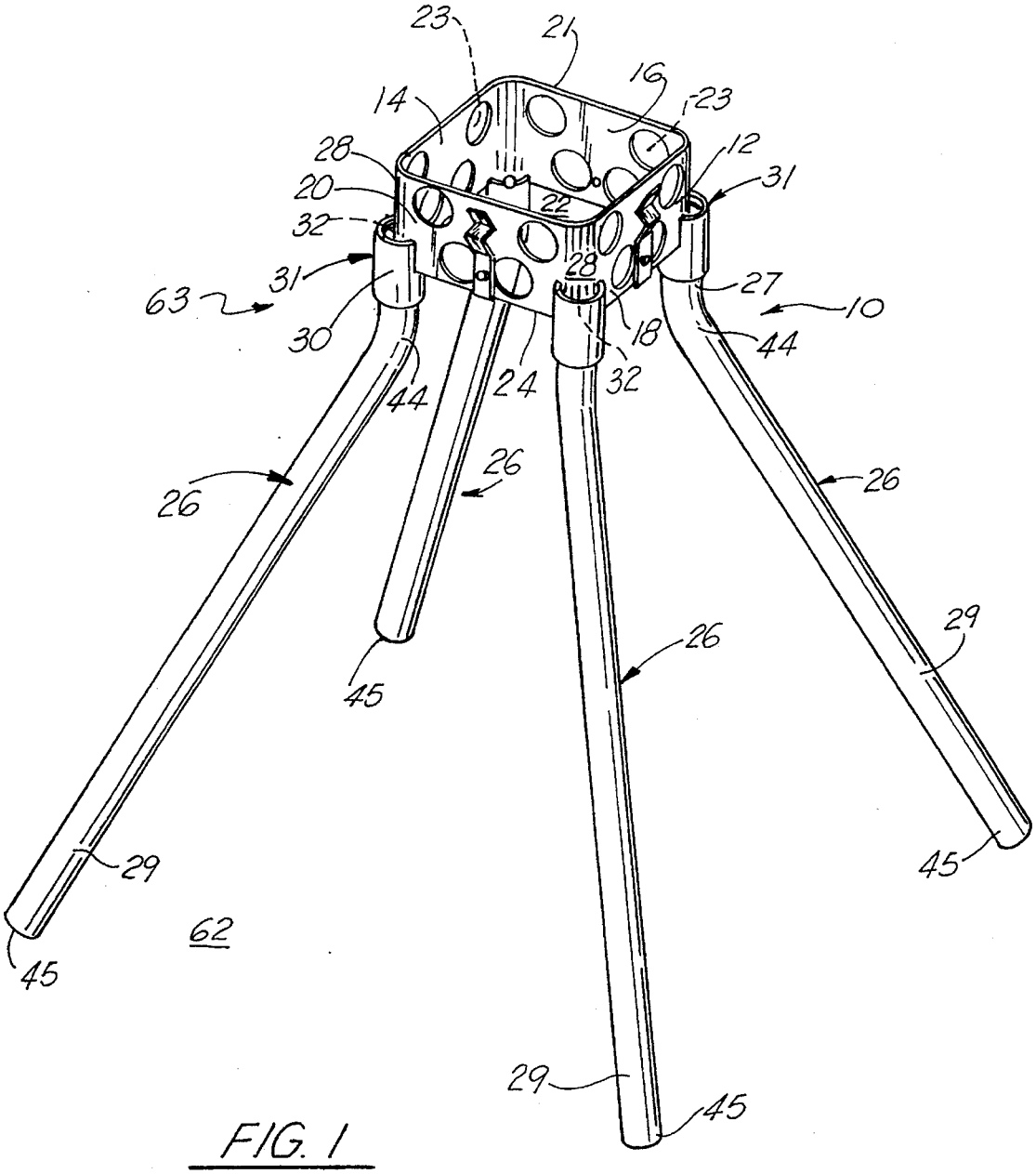
FIG. 1 illustrates an overall, perspective view of the preferred embodiment of the present invention fully assembled.

FIGS. 1 through 6 illustrate the preferred embodiment of the present invention by the numeral 10. As illustrated in perspective view in FIG. 1, individual sandbag accessory apparatus 10 comprises a central sandbag support frame 12 having a plurality of side walls 14, 16, 18, 20, each sidewall having an upper edge 21 and lower edge 24, and together defining a central frame opening 22 within support frame 12. Further, each of the sidewalls 14, 16, 18, 20 include a plurality of circular openings 23, in the preferred embodiment four openings 23 in each sidewall, the function of which will be discussed further.

Apparatus 10 further includes a plurality of leg members 26, each leg member 26 comprising an upper frame engaging portion 27, and a lower support portion 29. As seen in FIG. 1, the upper frame engaging portion 27 would engage to each corner 28 of support frame 12 via an engagement means 31 positioned at each corner of frame 12. This engagement means includes a collar member 30 positioned at each corner 28, and defining a central opening 32, wherein the upper frame engaging portion 27 of each leg 26 is slidably engaged.

Figure 5:
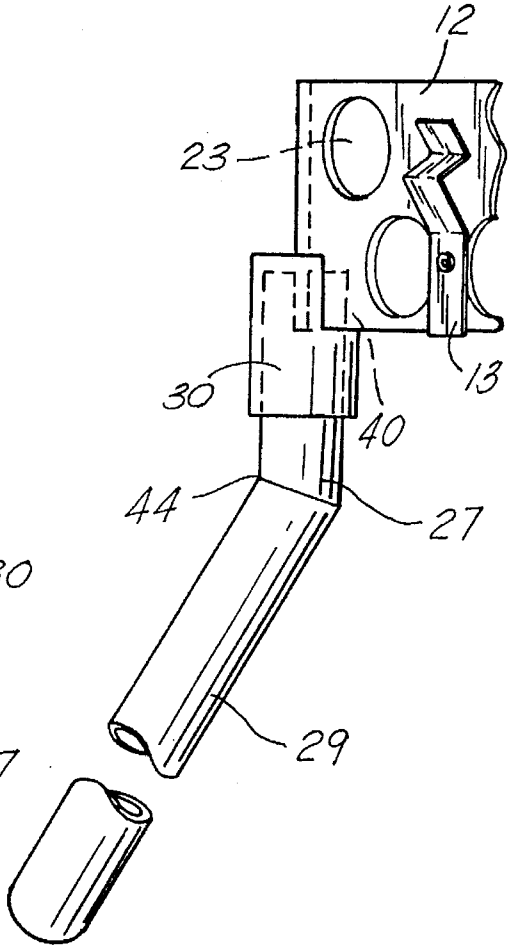
FIGS. 4 and 5 illustrate isolated, partial cutaway views of the leg attachment assembly in the preferred embodiment of the present invention.
Figure 4:
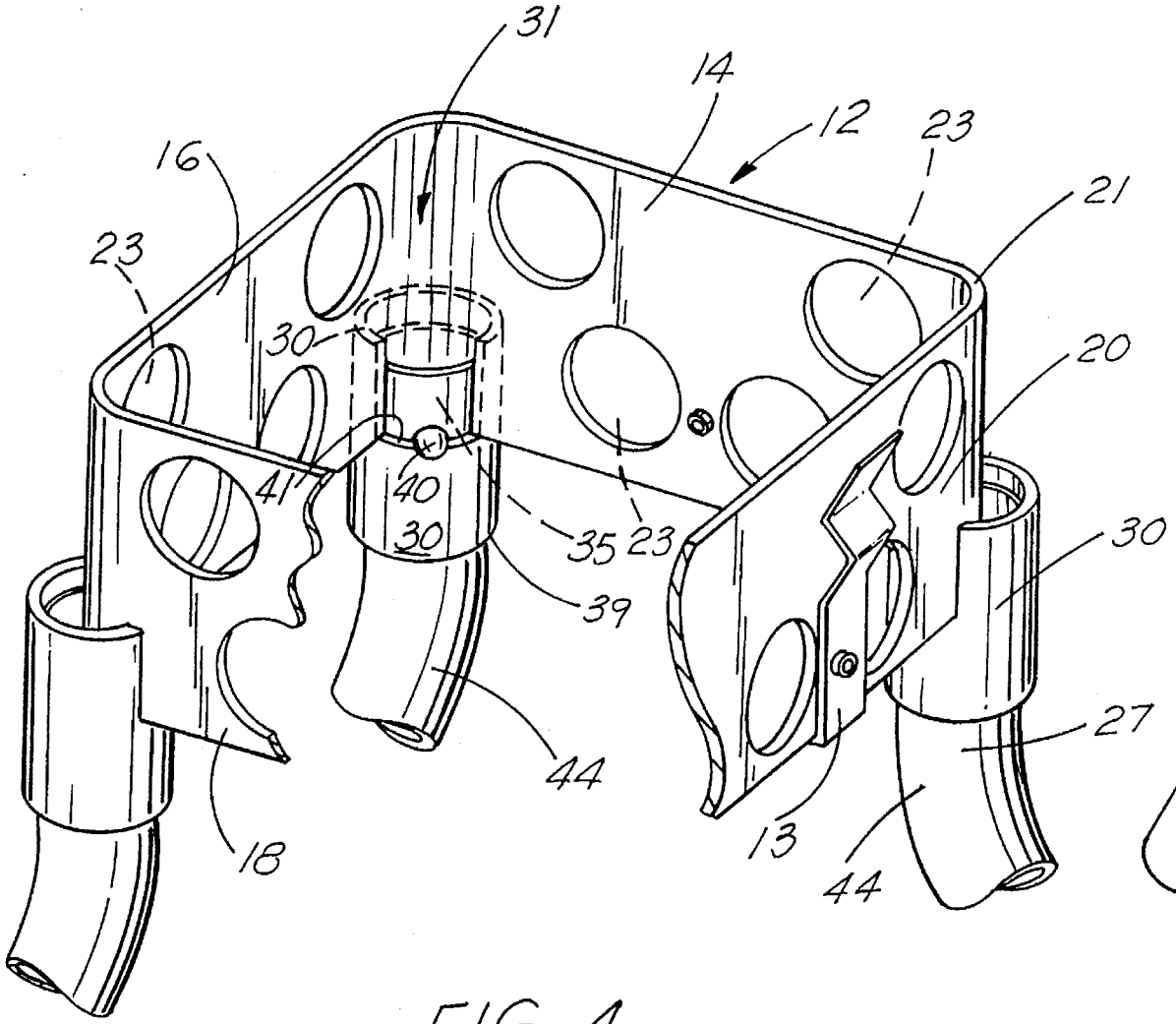
Figure 6:
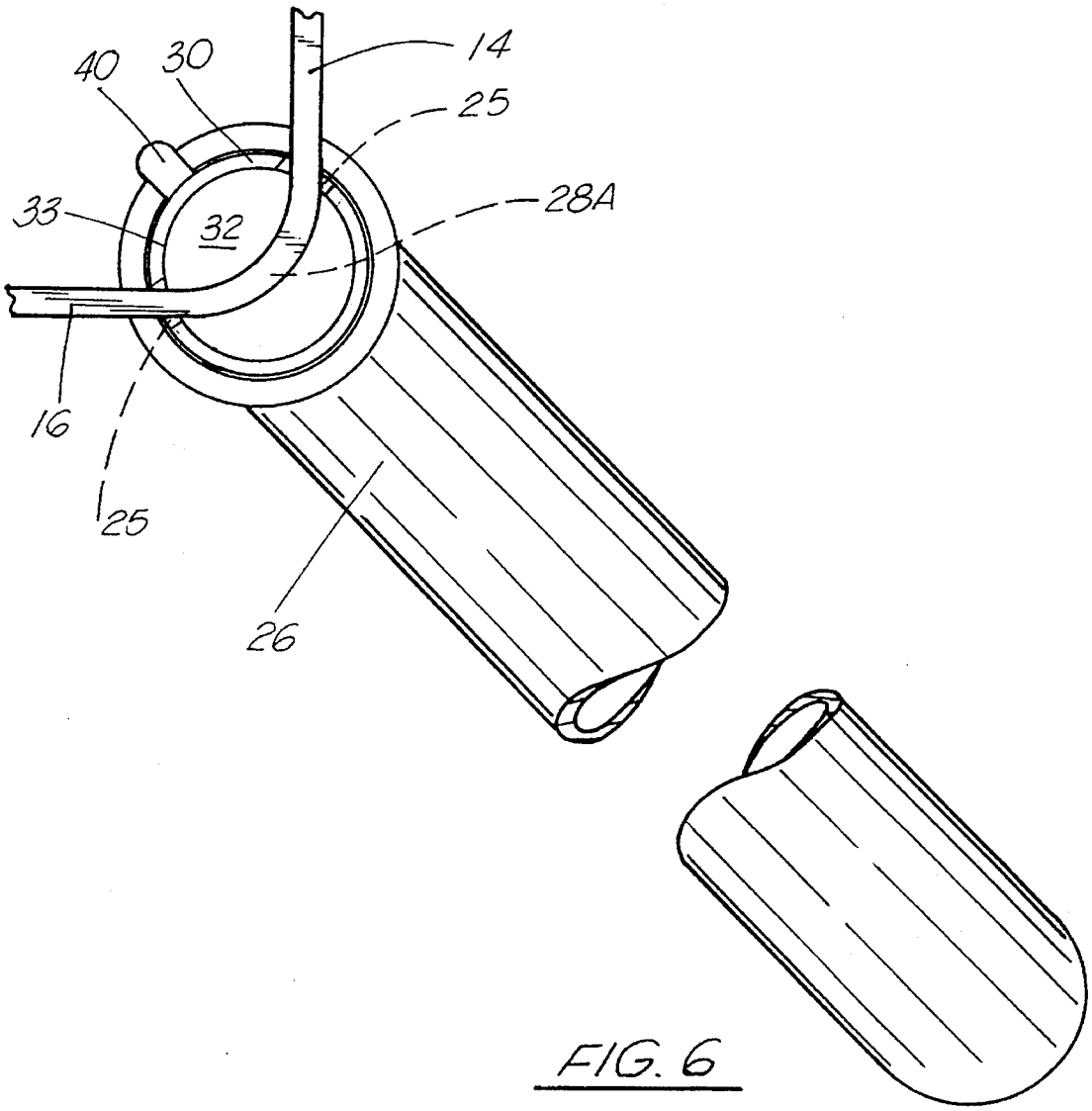
FIG. 6 illustrates a top view of the leg attachment assembly of the present invention.

The engagement between leg members 26 and collars 30 is illustrated more clearly in FIGS. 4 and 5. As illustrated, each collar member 30 is secured to each corner 28 of the frame 12, with the adjoining walls (for example, walls 14, 16) of the frame 12, at corner 28, extending through the wall of collar 30, with a portion 28A of each corner 28 positioned within space 32 of collar 30. This is illustrated in top view in FIG. 6. Further, the annular wall 33 of each collar 30 provides an internal cutaway portion 35, which is positioned interior to portion 28A of corner 44, as seen in FIG. 4. Each leg 26 provides a first upper spring-loaded button 40, positioned in the upper frame engaging portion 27 of each leg 26, and a pair of slots 25, cut in the upper end of portion 27 of leg 26. Therefore, when the upper portion 27 of each leg 26 is slidably engaged into each collar 30, the spring-loaded button 40 remains recessed, until button 40 is aligned with the cutaway portions 35 of wall 33, where button 40 is allowed to fully engage, and be seated on the upper edge 41 of the cutaway portions 35, again as illustrated in FIG. 6. Further, as seen in FIG. 6, each sidewall 14, 16 is engaged within each slot 25 in leg 26 so that the leg 26 may be fully engaged. After each leg 26 is engaged as described above, this completes the engagement of the legs 26 into the upper frame 12.

Figure 2:
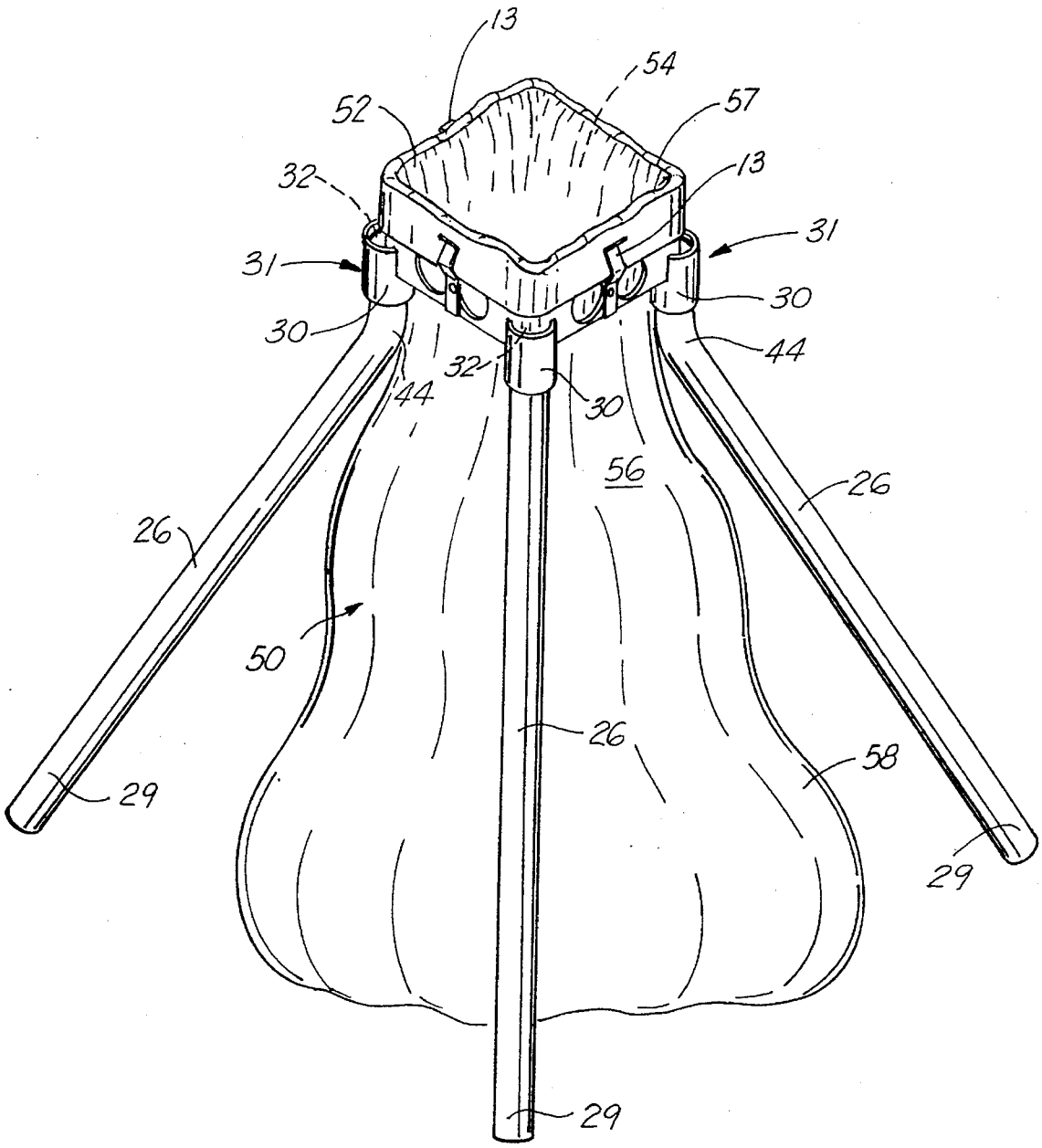
FIG. 2 illustrates an overall, perspective view of the preferred embodiment of the present invention fully assembled with a sandbag mounted thereon.

As further illustrated in FIG. 1, directly below the lower edge 39 of each collar 30, into which each frame engaging end 27 of each leg 30 is engaged, each leg 26 defines a bend 44 so that the lower end 45 of the lower support portion 29 of each leg 26 makes contact with surface 62, defining a truncated pyramid 63, with the legs providing an expanded contact area on surface 62, as opposed to the somewhat compact bag support frame 12. As seen in FIG. 2, this truncated pyramid configuration 63 adds stability to the apparatus when it is set upright supporting a sandbag.

FIG. 2 illustrates the assembled apparatus 10, supported upright via legs 26 engaging frame 12, with a sandbag 50 positioned thereupon. As illustrated, sandbag 50 includes an upper open end portion 52, having an opening 54, and a bag body 56, defined by a continuous fabric wall 58, into which sand is shoveled through upper opening 54. As seen, the upper end 57 of bag 50 has been slid through the central opening 32 in frame 12, and folded over the upper edge 21 of frame 12. Frame 12 includes a clip member 13 along each wall of the frame 12, for clip engaging the upper end 57 of bag 50 between the clip body 15 and each wall of frame 12. In this manner the opening 54 in each bag 50 is maintained opened while clipped, and the bag body 56 is supported sufficient distance from the ground so as to allow sand or the like to be shoveled into opening 54, until the bag is sufficiently filled. As seen in FIG. 2, because of the clips 13 engaging bag 50 in place, there is no need for a second person to hold the bag 50 open during the shoveling process.

Figure 3:
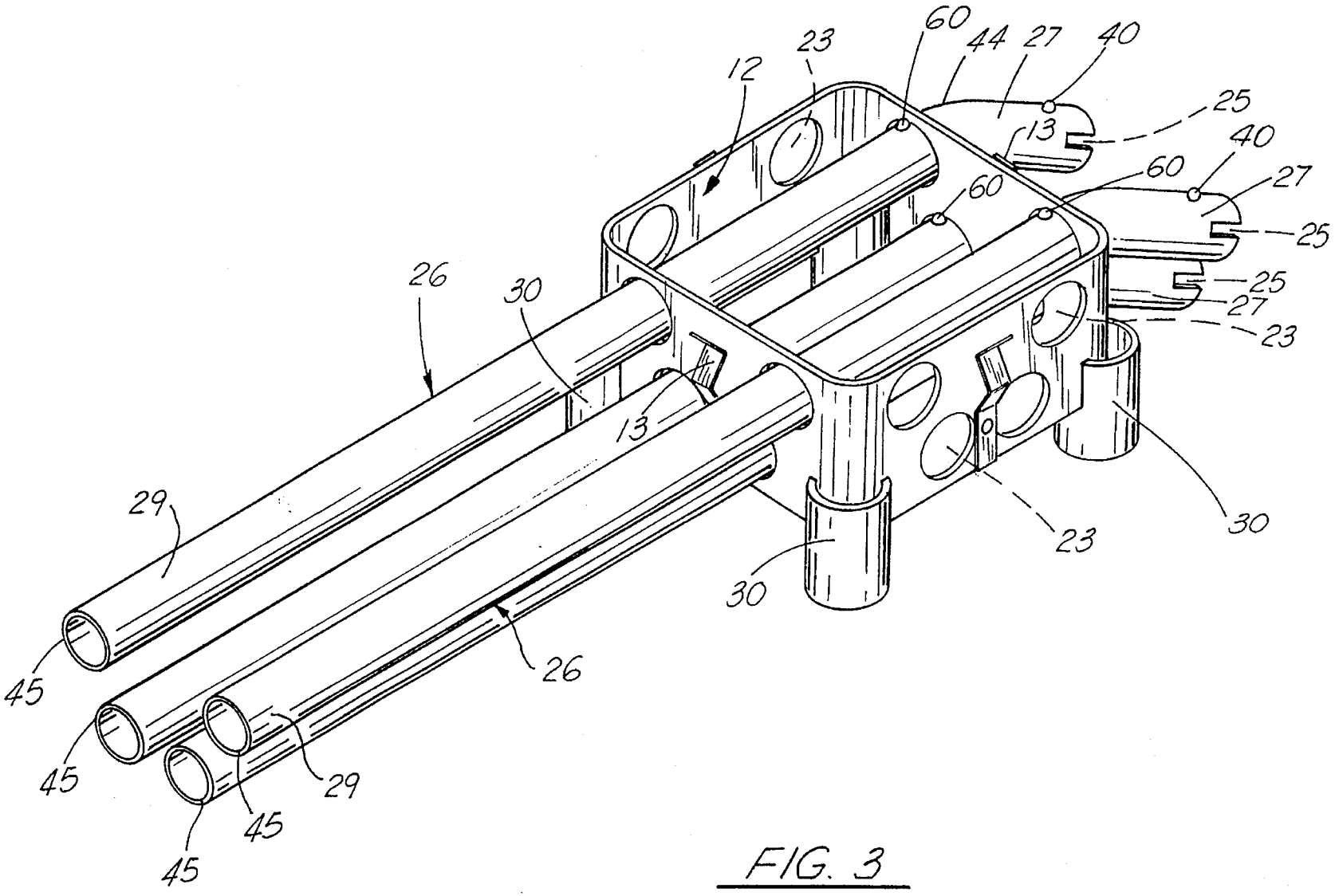
FIG. 3 illustrates an overall, perspective view of the preferred embodiment of the present invention in the fully stowed configuration ready for transport.

FIG. 3 illustrates the sandbag filling apparatus 10 which it is in the stowage position. As illustrated, each of the leg members 26 have been disengaged from each collar 30. Following this procedure, the lower support end 29 of each leg 26 is then slid through openings in two opposite walls, e.g., 14, 16 of the frame 12, until all four legs 26 have been slidably engaged through the four sets of circular openings 23 in opposing sidewalls 14, 16. It should be noted that the lower ends 45 of each leg 26 must be the leading end slid through openings 23 in frame 12, since the bend 44 at the upper end of each leg 26 would prevent that end from sliding through the ports 23 in frame 12. In order to maintain each leg 26 in place, there is provided a second spring loaded button 60 at the upper end of each lower support portion 29 of each leg 26. The lower support portion 29 of each leg 26 is slid through each port 22 in a first sidewall 14, until the bend 44 is adjacent the opening 22. At this position, each button 60 on leg 26 is recessed in order to allow it to pass through port 22. After the button 60 has passed through wall 22, it is allowed to return to its normally out position, which prevents the leg 26 from sliding back out of the port 22 during transport. In effect, legs 26 remain in the stowed position in frame 12 because the each leg is unable to continue to slide in the first direction, due to the angle at the bend 44 of each leg 26, while button 60 prevents the leg from sliding in the second direction.

As seen in the configuration illustrated in FIG. 3, apparatus 10 forms a very compact and linear unit which can be easily carried by soldiers in the field of by fire fighters. The stowage dimensions are approximately 19 inches by 7 inches by 4 inches, with an overall weight of 2.5 pounds. The quick release buttons 60 allow deployment in under a minute by one person using no tools. The construction materials are such that they would be resistant to chemical agents and decontaminates. The unit would be compatible with standard military sandbags, (ML-B-12233E), with no replacement parts and a life span of over 1,000 fillings of sandbags. During stowage and transport, the apparatus, because of its dimensions as stated earlier could be carried in or strapped onto a standard issue rucksack or carried in a standard sandbag.

In addition, the support frame, without the sandbag, may be used as a support apparatus for supporting a flat surface or the like during outdoor use. Although it is primarily designed as a support apparatus for a sandbag, this secondary use may be important during certain conditions in the field.

The following table lists the part numbers and part descriptions as used herein and in the drawings attached hereto.

PARTS LIST

| Description | Part No. |
|---|---|
| sandbag accessory apparatus | 10 |
| support frame | 12 |
| side walls | 14, 16, 18, 20 |
| clips | 13 |
| clip body | 15 |
| side wall upped edge | 21 |
| central frame opening | 22 |
| circular openings | 23 |
| side wall lower edge | 24 |
| slots | 25 |
| leg member | 26 |
| upper frame engaging portion | 27 |
| corner | 28 |
| corner portion | 28A |
| lower support portion | 29 |
| collar member | 30 |
| engagement means | 31 |
| central opening | 32 |
| annular wall | 33 |
| internal cutaway portion | 35 |
| wall cutaway portion | 37 |
| lower edge | 39 |
| spring loaded button | 40 |
| upped edge | 41 |
| port | 42 |
| bend | 44 |
| lower end | 45 |
| sandbag | 50 |
| upper open end | 52 |
| opening | 54 |
| bag body | 56 |
| fabric wall | 58 |
| upper end | 57 |
| 2nd spring loaded button | 60 |
| surface | 62 |
| truncated pyramid | 63 |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. An individual sandbagging accessory apparatus, comprising:

a) a sandbag support frame, having a plurality of sidewalls defining an opening therethrough;

b) a plurality of leg members removably engaged to the sandbag support frame for supporting the frame above the ground;

c) clip means mounted on the frame for engaging an upper end of a sandbag in the open position onto the sandbag support frame;

d) a plurality of openings in the sidewalls of the sandbag support frame for accommodating each of the leg members therethrough when the apparatus is in a stowage configuration; and e) means for maintaining the legs engaged through the plurality of openings in the sidewalls when the apparatus is transported in a knapsack or tote bag.

2. The apparatus in claim 1, wherein the legs are slidably engaged within a collar at each corner of the support frame.

3. The apparatus in claim 2, further including slots formed in the upper end of each leg member to further engage the leg members within a collar at each corner of the support frame.

4. The apparatus in claim 1, wherein the means for maintaining the legs engaged though the plurality of openings in the sidewalls comprises a spring-loaded button on each leg engagable into a port in the frame walls.

5. The apparatus in claim 1, wherein the apparatus defines a truncated pyramid when supporting a sandbag thereupon.

6. The apparatus in claim 1, further comprising means associated with the support frame for allowing the support frame to be strapped to a tote bag or knapsack for transport.

7. An individual sandbagging accessory apparatus, comprising:

a) a sandbag support frame, having a plurality of sidewalls, and further defining a central opening therethrough;

b) a plurality of leg members removably engaged within a collar at each corner of the sandbag support frame for supporting the frame above the ground;

c) clip members along each wall of the support frame for engaging an upper end of a sandbag in the open position onto the sandbag support frame d) a plurality of openings in the sidewalls of the sandbag support frame for accommodating the leg members therethrough when the apparatus is in a stowage configuration; and e) a recessible button on each leg member for maintaining each leg member engaged through the plurality of openings in the sidewalls when the apparatus is in the stowage configuration.

8. An individual sandbagging accessory apparatus, configurable from a first erected position for securing a sandbag thereto, to a second stowage position for transporting said accessory apparatus, the apparatus comprising:

a) a sandbag support frame, having a plurality of sidewalls, and further defining a central opening through which an upper end of a sandbag is passed;

b) a plurality of leg members removably engaged within a collar at each corner of the sandbag support frame for supporting the frame above the ground;

c) clip members along an outer face of each wall of the support frame for engaging an upper end of the sandbag passed through the opening in the support frame, and held in the open position onto the sandbag support frame, so that sand may be shoveled into the opened sandbag supported on the support frame by a single individual; and d) a plurality of ports in each of the sidewalls of the support frame, so that when each leg is disengaged from the support frame, each leg may be slidably engaged through respective ports in opposing sidewalls in order to configure the apparatus for stowage or transport.

9. The apparatus in claim 8 further comprising a recessible button on each leg member for maintaining each leg member engaged through the plurality of openings in the sidewalls when the apparatus is in the stowage configuration.

10. The apparatus in claim 8, wherein the legs are slidably engaged within a collar at each corner of the support frame.

11. The apparatus in claim 8, wherein the means for maintaining the legs engaged though the plurality of openings in the sidewalls comprises a spring-loaded button on each leg engagable into a port in the frame walls.

12. The apparatus in claim 8, further including slots formed in the upper end of each leg member to further engage the leg members within a collar at each corner of the support frame.

13. The apparatus in claim 8, wherein the apparatus defines a truncated pyramid when supporting a sandbag thereupon.

14. The apparatus in claim 8, further comprising means associated with the support frame for allowing the support frame to be strapped to a tote bag or knapsack for transport.

15. An individual sandbagging accessory apparatus, configurable from a first erected position for securing a sandbag thereto, to a second stowage position for transporting said accessory apparatus, the apparatus comprising:

a) a sandbag support frame, having a plurality of sidewalls, and further defining a central opening through which an upper end of a sandbag is passed;

b) a plurality of leg members removably engaged within a respective collar at each corner of the sandbag support frame for supporting the frame above the ground;

c) clip members along an outer face of each wall of the support frame for engaging an upper end of the sandbag passed through the opening in the support frame, and held in the open position onto the sandbag support frame, so that sand may be shoveled into the opened sandbag supported on the support frame by a single individual;

d) a plurality of ports in each of the sidewalls of the support frame, so that when each leg is disengaged from the support frame, each leg may be slidably engaged through each of the ports in opposing sidewalls in order to configure the apparatus for stowage or transport; and e) a recessible button on each leg member for maintaining each leg member engaged through the plurality of openings in the sidewalls when the apparatus is in the stowage configuration.

16. An accessory support apparatus, comprising:

a) a support frame, having a plurality of sidewalls defining an opening therethrough;

b) a plurality of leg members removably engaged to the support frame for supporting the frame above the ground;

c) a plurality of openings in the sidewalls of the sandbag support frame for accommodating each of the leg members therethrough when the apparatus is in a stowage configuration; and d) means for maintaining the legs engaged through the plurality of openings in the sidewalls when the apparatus is transported in a knapsack or tote bag.

* * * * *